US005184823A

United States Patent [19]

Desboilles et al.

[11] Patent Number: 5,184,823

[45] Date of Patent: Feb. 9, 1993

[54] GOLF CLUB AND GOLF CLUB HEAD

[75] Inventors: Jack Desboilles, Annecy; Claude Viste, Gruffy, both of France

[73] Assignee: Taylor Made Golf Company, Inc., Carlsbad, Calif.

[21] Appl. No.: 617,202

[22] Filed: Nov. 23, 1990

[30] Foreign Application Priority Data

Nov. 22, 1989 [FR] France ..... 89 15318

[51] Int. Cl.[5] ..... A63B 53/04

[52] U.S. Cl. ..... 273/167 F; 273/167 H; 273/171

[58] Field of Search ..... 273/77 R, 167-175, 273/DIG. 7, DIG. 23, 78

[56] References Cited

U.S. PATENT DOCUMENTS

| | | | |
|---|---|---|---|
| 1,568,888 | 1/1926 | Dunn | 273/167 H |
| 3,847,399 | 11/1974 | Raymont | 273/167 F |
| 4,214,754 | 7/1980 | Zebelean | 273/167 H |
| 4,313,607 | 2/1982 | Thompson | 273/167 H |
| 4,398,965 | 8/1983 | Campau | 273/78 X |
| 4,489,945 | 12/1984 | Kobayashi | 273/167 H |
| 4,502,687 | 3/1985 | Kochevar | 273/171 |
| 4,664,383 | 5/1987 | Aizawa . | |
| 4,792,139 | 12/1988 | Nagasaki et al. | 273/167 H |
| 4,798,383 | 1/1989 | Nagasaki et al. | 273/167 H |
| 4,874,171 | 10/1989 | Ezaki et al. | 273/77 A |
| 4,884,812 | 12/1989 | Nagasaki et al. | 273/167 H |
| 4,928,972 | 5/1990 | Nakanishi | 273/78 |
| 5,026,056 | 6/1991 | McNally | 273/77 A |

FOREIGN PATENT DOCUMENTS

| | | | |
|---|---|---|---|
| 211781 | 12/1957 | Australia | 273/167 F |
| 61-176372 | 8/1986 | Japan . | |
| 63-71272 | 3/1988 | Japan . | |
| 3267376 | 11/1988 | Japan | 273/167 H |
| 408103 | 4/1934 | United Kingdom | 273/169 |
| 1534471 | 12/1978 | United Kingdom . | |
| 2100993 | 1/1983 | United Kingdom . | |

*Primary Examiner*—V. Millin
*Assistant Examiner*—Sebastiano Passaniti
*Attorney, Agent, or Firm*—Sandler, Greenblum & Bernstein

[57] ABSTRACT

A golf club head and a method of constructing a golf club head. The head includes an assembly of walls surrounding an internal cavity; a striking wall having an inner face facing the internal cavity, the inner face of said striking wall having a periphery which is connected to a plurality of the assembly of walls; and at least one of the plurality of walls including a ballasting weight extending into the cavity, the ballasting weight being disposed proximate to the inner face of the striking wall, but being separated from the inner face of the striking wall by an interstitial space communicating with the cavity.

25 Claims, 3 Drawing Sheets

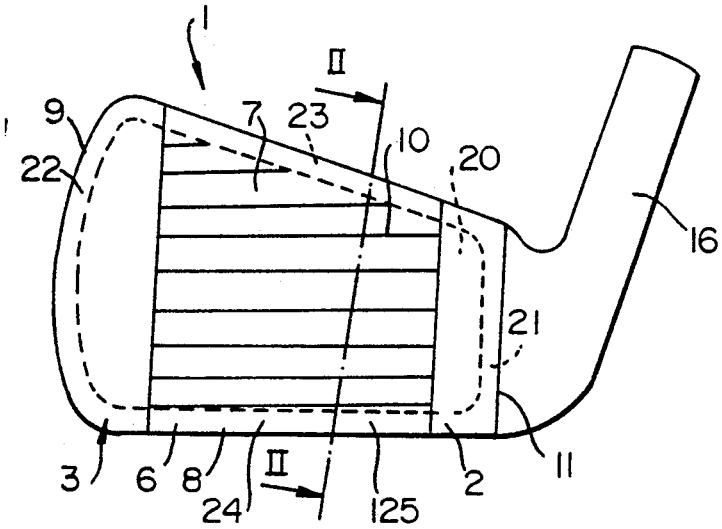
Fig - 1
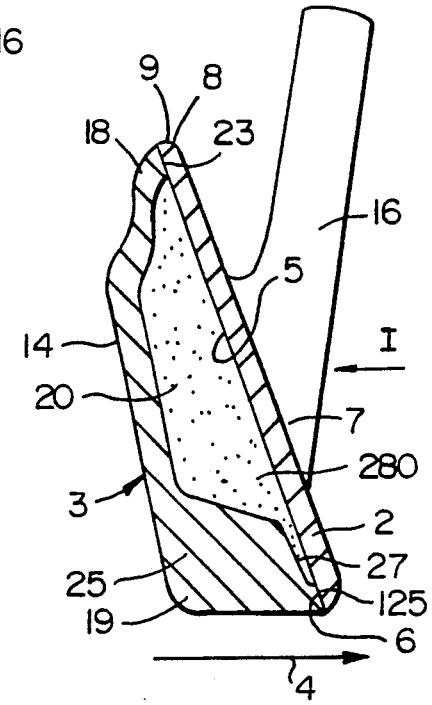
Fig - 2
Fig - 3
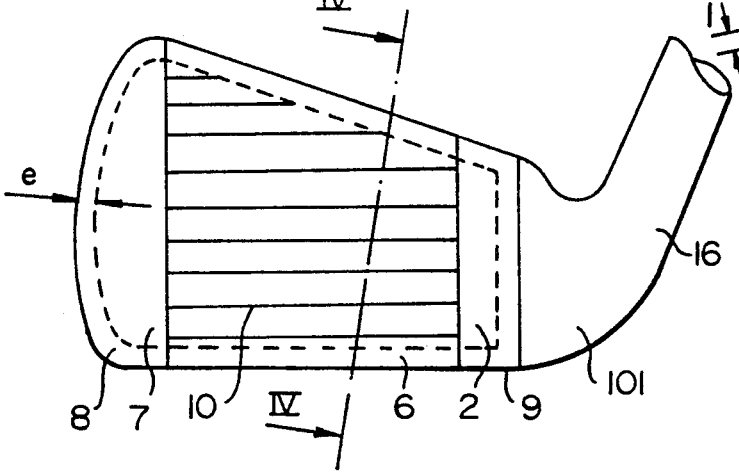
Fig - 4
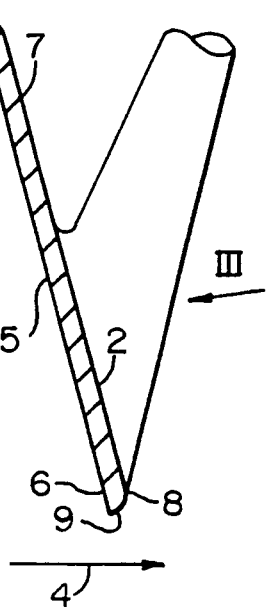

GOLF CLUB AND GOLF CLUB HEAD

BACKGROUND OF THE INVENTION

1. Field of the Invention

This invention relates to a golf club head, and a method of constructing such a head. More specifically, this invention relates to the manufacture of a golf club head, of the iron or wood type, including an assembly of walls defining an internal cavity and including a striking wall having an inner face facing towards the cavity, connected peripherally at all points to other walls of the assembly, and a ballasting weight provided within the cavity.

2. Description of Background and Other Information

A head of above-mentioned type is described, for example, in Japanese patent application No. 61/176372, which shows in FIG. 6 a wood head provided with a ballasting weight in a lower part of a cavity. The ballasting weight is intended to influence both the overall mass of the head and the position of the center of gravity of the head. In the foregoing, as well as in what follows, expressions such as "lower" and "upper", and other such expressions, refer to a normal position of the club head, when used by a golfer, at the instant that the head strikes a ball. Further, expressions such as "front" and "rear" are to be understood with reference to a direction of movement of the head when this impact, or striking, of the ball takes place. Thus, the striking wall closes the internal cavity of the head of the club at the front, and its inner face is directed towards the rear.

The only disclosure with can be obtained from the aforementioned Japanese patent application concerning the position of the ballasting weight and, as a consequence, the center of gravity of the club head, is revealed from an examination of FIG. 6 of the application, which shows that the weight and, consequently, the center of gravity, are very much offset to the rear with respect to the impact wall.

In some circumstances, it is preferable, however, to have a center of gravity which is comparatively closer to the striking wall and, for this purpose, Japanese patent application No. 63/71272 proposes in FIG. 1 that a club head, in particular a wood head, is ballasted by means of a weight provided by an integral wall portion of increased thickness on the striking wall itself, and has a thickness which increases from top to bottom with reference to the latter.

This arrangement certainly makes it possible to place the center of gravity close to the striking wall, but it has the major disadvantage of influencing the behavior of the latter when it impacts against the ball, so that it behaves in a heterogeneous manner as a result of the heterogeneity in its thickness, with reference to the striking wall.

SUMMARY OF THE INVENTION

An object of this invention is to position the ballasting weight within golf club head, whether an "iron" or a "wood" type of club, the ballast weight being located within a cavity in the head, but to avoid the disadvantages of the prior art, by placing the center of gravity as close as possible to the striking wall so as not to disturb the reactions of the latter on impact.

To this end, the present invention is directed to a golf club head including:

an assembly of walls surrounding an internal cavity;

the assembly of walls including a striking wall having an inner face facing the internal cavity, the inner face of the striking wall having a periphery which is connected to a plurality of the assembly of walls; and at least one of the assembly of walls including a ballasting weight extending into the cavity, the ballasting weight having at least an upper portion disposed separated from the inner face of the striking wall by an interstitial space, communicating with the cavity, but proximate to the inner face of the striking wall.

The golf club head according to the present invention can be alternatively defined as including:

an assembly of walls surrounding an internal cavity;

a striking wall having an inner face facing the internal cavity, the inner face of the striking wall having a periphery which is connected to a plurality of the assembly of walls; and at least one of the plurality of walls including a ballasting weight extending into the cavity, the ballasting weight being disposed proximate to the inner face of the striking wall, but being separated from the inner face of the striking wall by an interstitial space communicating with the cavity.

According to a particular aspect of the invention, the ballast weight is integral with the at least one of the plurality of walls and is defined by at least a portion of the at least one of the plurality of walls having an increased thickness.

Preferably, according to the invention, the interstitial space has a substantially constant width between the ballast weight and the inner face of the striking wall.

Also according to a preferred embodiment of the invention, the plurality of walls define a continuous edge of substantially constant thickness extending around the periphery of the inner face of the striking wall.

Still further, the interstitial space between the ballast weight and the inner face of the striking wall has a substantially constant width substantially smaller than the substantially constant thickness of the continuous edge.

Preferably, according to the invention, the width of the interstitial space is approximately one-fourth of the substantially constant thickness of the continuous edge.

In one particular embodiment of the invention, the cavity is completely enclosed.

In a preferred embodiment of the invention, a filling material fills the cavity and the interstitial space.

The ballast weight is located in a lower part of the cavity, in a particular embodiment of the invention.

The ballast weight can also be located in the heel portion of the cavity.

Still further, the ballast weight can also be located in the toe portion of the cavity.

In a particular embodiment, the ballast weight is located in the lower, heel, and toe portions of the cavity.

Preferably, according to the invention, the ballast weight is constructed as a unitary block with at least one of the plurality of walls.

Further according to a particular embodiment of the invention, the plurality of walls is constructed as a unitary block. The striking wall abuts against the plurality of walls, according to the invention.

Still further according to particular embodiment of the invention, the striking wall has a continuous peripheral edge extending around the inner face of the striking wall, the plurality of walls together form a continuous annular edge confronting the inner face of the striking wall and are arranged for cooperation with the continuous peripheral edge of the striking wall. the continuous peripheral edge and the continuous annular edge being connected together in an integral manner.

According to a still further aspect of the invention, the inner face, the continuous peripheral edge, and the continuous annular edge are substantially planar.

According to a further aspect of the invention, the continuous peripheral edge and the continuous annular edge are secured together by welding, brazing, or adhesive bonding.

According to a particular aspect of the invention, the interstitial space is continuous, being uninterrupted.

According to a particular embodiment of the invention, a rear wall is connected to the plurality of walls.

Still further according to the invention, an end piece is connected to one of the plurality of walls, and the end piece is configured for connection to a shaft.

Alternatively, the end piece is connected to the striking wall, and the end piece is configured for connection to the shaft.

Also according to the present invention, a shaft is connected to the aforementioned golf club head.

The present invention also includes the method of making the aforementioned golf club head.

In particular, the method of the invention includes the steps of:

forming a plurality of walls as a unitary block and thereby forming a continuous annular edge;

disposing a weight in close proximity to a geometrical surface containing the annular edge, but set back from the geometrical surface;

forming a striking wall with a face complementary with the geometrical surface and having a continuous peripheral edge extending about the face, the continuous peripheral edge thereby is complementary to the continuous annular edge;

assembling the unitary block and the striking wall with the continuous peripheral edge and the continuous annular edge in cooperation, thereby defining an internal cavity and a continuous interstitial space communicating with the internal cavity between the weight and the face; and fastening the continuous peripheral edge and the continuous annular edge securely together.

Preferably, according to the invention, the step of disposing the weight includes setting back the weight from the geometrical surface by a substantially uniform distance.

Additionally, the step of forming the annular edge includes forming the annular edge to have a substantially constant thickness.

Also preferably according to the method of the invention, the weight is set back by a distance which is substantially less than the thickness of the annular edge. More specifically, the weight is set back by a distance equal to approximately one-fourth of the thickness of the annular edge.

Further according to the method of the invention, the other walls and the weight are so constructed that the cavity is enclosed.

Still further according to the method of the invention, the cavity and the interstitial space are filled with a filling material.

According to a particular embodiment of the method of the invention, the step of disposing the weight includes locating the weight in a lower part of the cavity.

Further, the step of disposing the weight can include locating the weight in a heel portion of the cavity.

Still further, the step of disposing the weight can include locating the weight in a toe portion of the cavity.

Further according to a particular embodiment of the method of the invention, the face, the continuous peripheral edge and the continuous annular edge are all formed to be substantially planar.

Additionally, according to the method of the invention, the step of fastening the continuous peripheral edge and the continuous annular edge securely together includes fastening the continuous peripheral edge and the continuous annular edge by means of one of the group consisting of welding, brazing, and adhesive bonding.

The method of the invention can further include the step of forming an end piece on the striking wall and connecting a shaft to the end piece.

Alternatively, the method of the invention can further include the step of forming an end piece on one of the assembly of walls and connecting a shaft to the end piece.

BRIEF DESCRIPTION OF THE DRAWINGS

The above and additional objects, characteristics, and advantages of the present invention will become apparent in the following detailed description of preferred embodiments, with reference to the accompanying drawings which are presented as non-limiting examples, in which:

FIGS. 1 to 7 illustrate a first embodiment of the invention, and more specifically:

FIG. 1 shows a front view of a head according to the invention in a direction indicated by an arrow I in FIG. 2;

FIG. 2 shows a view of this head in cross-section along a plane indicated by II—II in FIG. 1;

FIG. 3 shows a front view of the striking wall of the head in a direction indicated by an arrow III in FIG. 4;

FIG. 4 shows a view of the striking wall in cross-section along a plane indicated by IV—IV in FIG. 3;

FIG. 5 shows a front view of the other walls of the head in a direction indicated by an arrow V in FIG. 6;

FIG. 6 shows a view of the other walls in cross-section in a plane indicated by VI—VI in FIG. 5;

FIG. 7 show a view similar to that of FIG. 5 with a different distribution of the weight over the other walls of the head;

FIG. 8 shows a front view of the striking wall of the head in a direction indicated by an arrow VIII in FIG. 9;

FIG. 9 shows a view of the striking head in cross-section along a plane indicated by IX—IX in FIG. 8;

FIG. 10 shows a front view of the other walls of the head in a direction indicated by an arrow X in FIG. 11; and FIG. 11 shows a view of the other walls in cross-section along a plane indicated by XI—XI in FIG. 10.

DETAILED DESCRIPTION OF PREFERRED EMBODIMENTS

To achieve the objects of the present invention, a golf club head of the "iron" or "wood" type is provided which incorporates an assembly of walls defining an internal cavity which includes a striking wall which has an inner face facing the internal cavity which is connected around the entire periphery thereof to other walls of the assembly, at least one of the other walls having an integral ballasting weight extending therefrom into the interior of the cavity, the weight being placed in close proximity to the inner face of the striking wall, but being separated from this face by a continuous, i.e., uninterrupted, interstitial space which communicates with the cavity.

Being placed in the intermediate proximity of the inner face of the striking wall, the weight will confer a center of gravity upon the club head which is itself located close to this inner face and, at the same time, the continuous interstitial space separating the weight from the inner face of the striking wall will mean that the behavior of the latter on impact is not disturbed by the presence of the weight.

Advantageously, the interstitial space has a substantially constant width between the weight and the inner face of the striking wall. In this way, the dimension can, if desired, be given a value just sufficient to avoid any contact with the striking wall.

The use of a weight separated from the inner face of the flat striking wall by means of a continuous interstitial space makes it possible for a continuous annular edge defined by the other walls to have a substantially constant thickness where this edge is joined to the inner face of the striking wall, even where it is desired that the center of gravity should be as close as possible to the striking wall.

The striking wall is not thereby further disturbed in its behavior on impact as a result of its connection to the other walls. If it is desired to place the center of gravity particularly close to the striking wall, the interstitial space can have a width which is substantially less than the aforementioned edge thickness and, for example, may be on the order of one-quarter of the latter.

Figure 6:
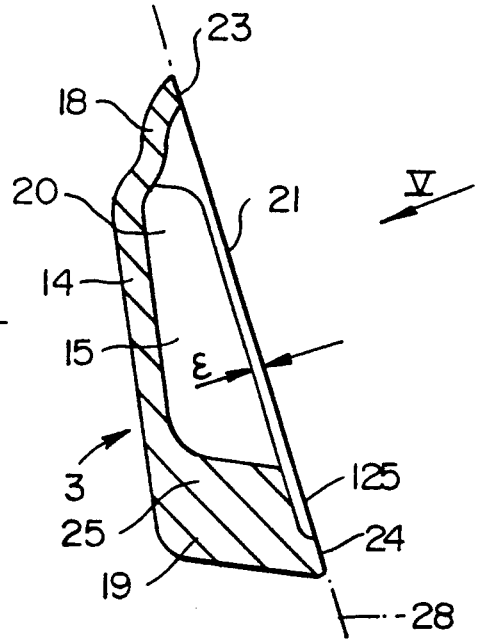

The cavity may be open, as disclosed in Japanese patent application No. 61/176372, in FIG. 6 thereof, or, alternatively, closed or at least substantially closed, whereby the cavity and the interstitial space can be filled with a filling material, which is selected in such a way that its presence between the weight and the impact wall does not disturb the behavior of the latter on impact.

The ballast weight, conveniently formed by an increased wall thickness, may be located in a lower part of the cavity as proposed by Japanese patent application No. 61/176372, but it may also be located in a heel part of the cavity and/or in a toe part of the cavity, depending upon the desired position of the center of gravity of the club head.

Further, a club head according to the invention may be constructed by different means. Nevertheless, it is preferred that the weight should be constructed as a single integral block with the one of the aforementioned other walls which bears it, and that the other walls should themselves be constructed as a single block, while the striking wall is preferably fitted to them.

Also in accordance with the invention, a method is provided for the construction of a golf club head comprising an assembly of walls defining an internal cavity and including a striking wall with an inner face facing the internal cavity and connected around the periphery thereof to other walls of the assembly, and at least one of the other walls having an integral weight formed by a part of increased thickness protruding towards the interior of the cavity, the method comprising the steps of so forming the other walls as a unitary block that the other walls define a continuous annular edge and the weight is disposed in close proximity to a geometrical surface containing the annular edge, but set back from the geometrical surface, forming the striking wall with a face complementary to the geometrical surface and having a continuous peripheral edge extending thereabout, the continuous peripheral edge thereby being complementary to the continuous annular edge, assembling the unitary block and the striking wall with the continuous peripheral edge and the continuous annular edge in cooperation, whereby to define the internal cavity and a continuous interstitial space communicating with the internal cavity between the weight and the face, and fastening the continuous peripheral edge and the continuous annular edge securely together. If desired, the cavity and the interstitial space can subsequently be filled with filling material.

It will be clear to one skilled in the art that the face of the striking wall which complements the aforesaid geometrical surface constitutes the inner face of the striking wall in the completed club head and that the distance by which the weight is set back with respect to the aforesaid geometrical surface corresponds to the width of the interstitial space as defined above.

By means of this method, the striking wall of the club head has a continuous peripheral edge around the inner face of the striking wall, and the other walls have corresponding edges which extend the inner face of the striking wall and together form a continuous annular edge which complements the aforementioned continuous peripheral edge, and the continuous peripheral edge and the continuous annular edge are securely fixed together.

With the objective of greater ease of design and manufacture, it is preferred that the face or inner face of the striking wall, the continuous peripheral edge of the latter and the continuous annular edge should be planar.

Advantageously, the continuous peripheral edge and the continuous annular edge are bonded together by means selected from a group which includes welding, brazing, and adhesive bonding. If surface irregularities on the outside of the club head result from the means used to bond the striking wall and the other walls together, these irregularities will be located away from the face of the striking wall which is opposite the inner face thereof, i.e., the face used to strike a ball, with the result that the striking face can be constructed accurately when constructing the striking wall, and that the finishing operations which are used to remove any surface irregularities resulting from bonding the striking wall to the other walls does not affect the striking face.

With regard to the drawings, reference will first be made to FIGS. 1 to 7.

In each of the figures, the golf club head 1 according to the invention includes striking wall 2 and a hollow body 3, the hollow body including the other walls, further described below. The striking wall 2 and the hollow body 3 forms a single block. In these figures, the head is illustrated in a normal striking position against a ball under the effect of the displacement of head 1 in an approximately horizontal direction 4, with reference to which striking wall 2 faces forwardly, and also slopes backwardly in the non-limiting example of an iron, as illustrated. It is to be understood that a wood may also be constructed in accordance with this invention.

As shown in particular by FIGS. 2 and 4, striking wall 2 is flat, and is bounded to the rear by a flat rear face 5 which has a continuous peripheral edge 6 which is also flat and co-planar with it and completely surrounding it, and to the front by a face 7 which is designed to strike a ball, this front face or striking face 7 being of a generally flat shape and substantially parallel to rear face 5, although it may have different surface conditions such as, for example, horizontal scores 10 associated with its function of striking a ball, and being peripherally attached by a convex edge 8 to the peripheral edge 6 of rear face 5 along a perimeter 9 of wall 2 except in a local area 11 of perimeter 9, where a connection zone 101 provides a connection to an end piece 16 which is configured to accept a shaft.

Wall 2 is generally constructed as a single piece, and may be made of metal or of some other material, but it may also be constructed by the assembly of several parts, in particular of different materials, without thereby going beyond the scope of this invention.

Body 3 is itself preferably constructed as a single piece, of metal or other material, it being understood that this material may be identical to or different from that of wall 2, and that it will not go beyond the scope of this invention if body 3 is itself constructed by the assembly of several parts of an identical or different material.

Figure 5:
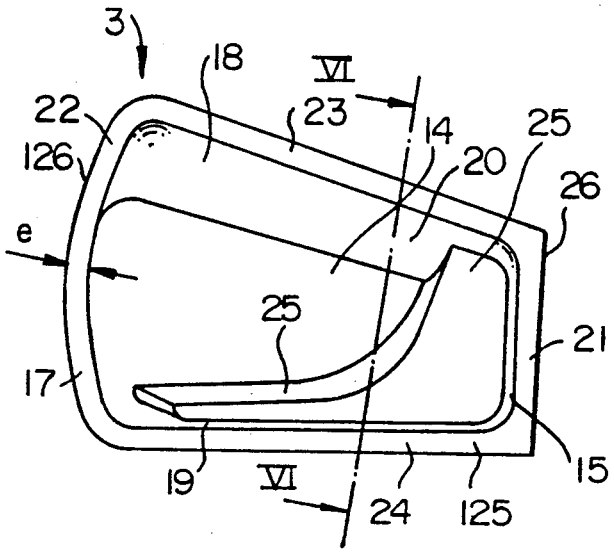

As shown more particularly in FIGS. 5 and 6, body 3 incorporates in an integral way, as a single block in the example illustrated, a rear wall 14, a heel wall 15, a toe wall 17, an upper wall 18 and a lower wall 19, walls 15, 17, 18, 19 forming a continuous forwardly facing edge around wall 14 in such a way that body 3 bounds an inner cavity 20 on all sides except the front.

To the front, each of walls 15, 17, 18, 19 has a corresponding flat edge 21, 22, 23, 24, these edges being mutually co-planar and together defining a flat continuous annular edge 125 which borders cavity 20 and has a geometry which strictly complements the geometry of peripheral edge 6 of rear face 5 of wall 2. As a result of this configuration, as shown more particularly in FIG. 2, peripheral edge 6 of rear face 5 of striking wall 2 can be closely fitted to the annular edge 125 of body 1 by turning the rear face 5 of impact wall 2 towards the interior of cavity 20 and making impact wall 2 integral with cavity 20 by fastening peripheral edge 6 and annular edge 125 by an appropriate means such as welding, brazing, or adhesive bonding. If the means of bonding used leaves surface irregularities on head 1, these surface irregularities would be located around the perimeter 9 of striking wall 2, i.e., in an area from which they may be easily removed by grinding, for example, without damaging impact face 7.

In accordance with the preferred embodiment of the invention illustrated in FIGS. 1 to 7, corresponding edges 21, 22, 23, 24 of walls 15, 17, 18, 19 of body 1 have corresponding constant and substantially identical thicknesses e which correspond to a substantially constant width 1 of peripheral edge 6 of rear face 5 of wall 2. Thickness e and width 1 may be on the order of 4 millimeters, for example, in the case of a wall 2 and a body 3 which are both made of metal and are assembled together by welding, although this example is not in any way to be considered limiting.

In ordinary circumstances, the different walls 14, 15, 17, 18, 19 of body 3 have a substantially constant thickness equal to e, except in particular localities.

Furthermore, and in a manner characteristic of this invention, some of the walls of body 3 are locally thickened, towards the interior of cavity 20, to form a ballasting weight 25 which is preferably constructed to be integral, i.e., unitary, with body 3.

Figure 7:
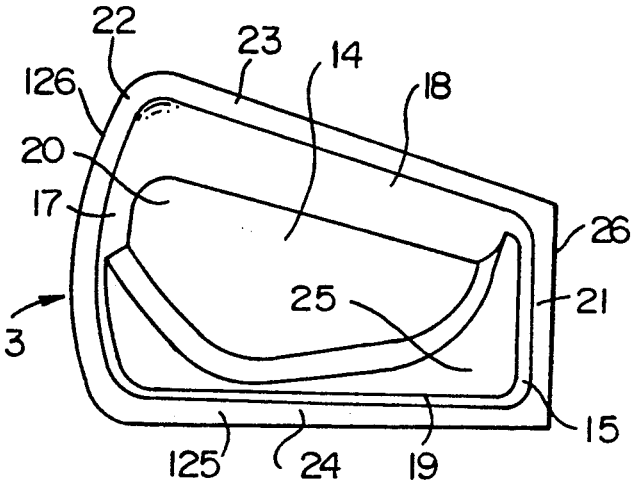

This weight 25 may be located, in a manner which is not illustrated, essentially in a lower part of the cavity, i.e., it may essentially consist of a greater wall thickness in lower wall 19. However, as illustrated, weight 25 may be located not only in a lower part of cavity 20, but also in a heel part of the cavity, thus forming a greater wall thickness towards the interior of cavity 20 with respect to heel wall 15 (FIG. 5), and/or in a toe part 126, in which case it forms a thickness increased towards the interior of cavity of 20 with respect to toe wall 17 (FIG. 7).

Whatever the manner in which it is thus located, and whatever the manner in which it is constructed, weight 25 is arranged in a manner characteristic of this invention in such a way that, while being placed in the immediate proximity of rear face 5 of wall 2 when wall 2 is assembled with body 3, as illustrated in FIG. 2, it remains separated from the face 5 by a continuous interstitial space 27 which communicates continuously with cavity 20 and, when the latter is filled with a filling material 280 after wall 2 has been attached to body 3, is itself filled with this material without discontinuity with respect to cavity 20.

For this purpose, with body 3 to be assembled to striking wall 2, as shown more particularly in FIG. 6, weight 25 is wholly set back towards the interior of cavity 20 with respect to a plane surface 28 formed by annular edge 125 of body 3 by an amount $\epsilon$ which is preferably substantially constant and substantially smaller than thicknesses e and width 1 and, for example, is on the order of one-quarter of e or 1, i.e., on the order to 1 millimeter in the non-limiting dimensioned example indicated above.

The value $\epsilon$ by which weight 25 is set back with respect to plane 28 forms the width $\epsilon$ of interstitial space 27 with reference to rear face 5 of wall 2, the face 5 being positioned in plane 28 when wall 2 is assembled with body 3.

In the example illustrated, weight 25 not only forms an increased thickness towards the interior of cavity 20 with respect to walls 15, 19, and 17, with which it is connected directly, but also with respect to the rear wall 14 of body 3, which makes it possible for the latter to be constructed as a single block by molding. Nevertheless, in other embodiments of the invention, weight 25 may occupy a greater or lesser space with respect to rear wall 14 and, likewise, the rear wall 14 may be omitted, in which case cavity 20, instead of being wholly closed after the assembly of body 3 with striking wall 2 as is the case in the example illustrated, will be partly open, in particular towards the rear.

Furthermore, in accordance with other embodiments of this invention, rear face 5 of striking wall 2 and its peripheral edge 6 may have shapes which differ from a planar shape, in which case annular edge 125 of body 3 will itself have a shape which differs from a planar shape and is in practice strictly complementary to the shape of peripheral edge 6 of rear face 5 of wall 2, and weight 25 is set back with respect to a surface generated by edge 125 and strictly complementary to the rear face 5 of wall 2 in the same way that flat surface 28 is complementary to the rear face 5 of wall 2 in the example illustrated.

Figure 8:
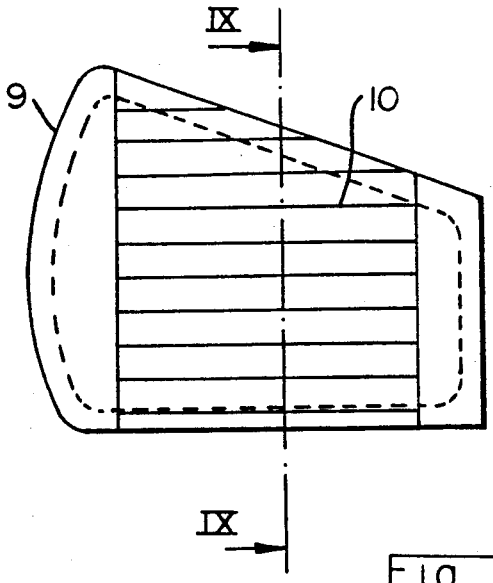
FIGS. 8 to 11 illustrate a second embodiment of the invention, and more specifically.
Figure 9:
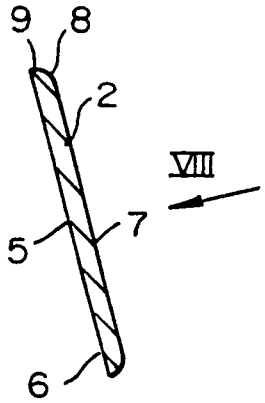

In this first embodiment, it is wall 2 which is integral with end piece 16, but it may be entirely otherwise. In fact, end piece 16 may be integral with the assembly of walls 14, 15, 17, 18, 19 defining cavity 20. This is the embodiment illustrated in FIGS. 8 and 11.

In accordance with this alternative embodiment as illustrated in FIGS. 8, 9, 10, 11, end piece 16 is connected to body 3 by a connection zone 101. Striking wall 2 is restricted to a flat plate bounded to the rear by a flat rear face 5 which also has a flat continuous peripheral edge 6 co-planar with it and bounding it at all points, and to the front by a face 7 which is designed to strike a ball, this front face or striking face 7 being of a generally planar shape and substantially parallel to rear face 5, although it may have different surface conditions, such as, for example, horizontal scores 10, associated with its functions of striking the ball, and is peripherally attached by means of a convex edge 8 to the peripheral edge 6 of rear face 5 along a perimeter 9 of wall 2.

Body 3 is itself preferably constructed as a single piece of metal or other material, it being understood that this material may be identical to or different from that of wall 2 and that it will not go beyond the scope of this invention if body 3 is itself constructed by the assembly of several parts of an identical or different material.

Figure 10:
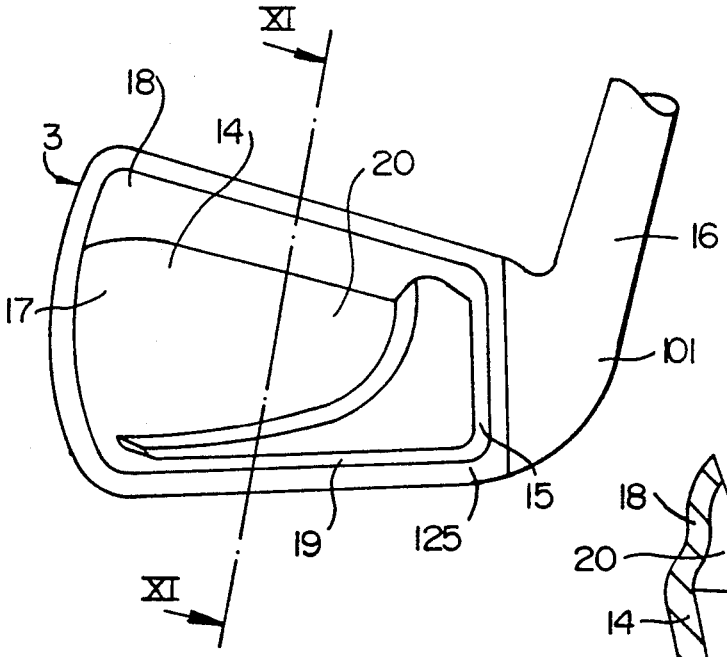
Figure 11:
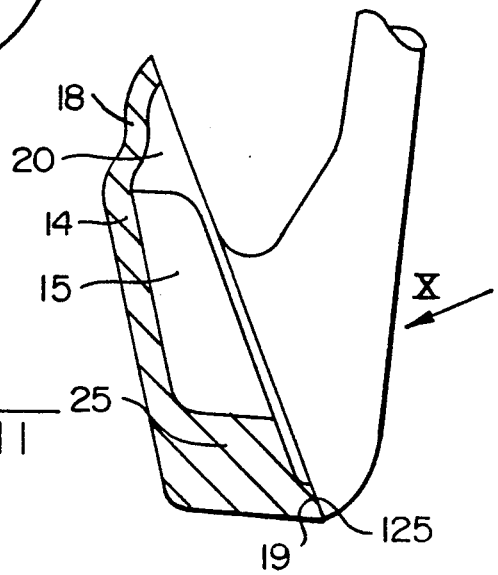

As illustrated more particularly in FIGS. 10 and 11, body 3 incorporates in an integral way, as a single block in the example illustrated, a rear wall 14, a heel wall 15 incorporating in an integral way, for example, also as a single block, an end piece 16 to accept a shaft, a toe wall 17, an upper wall 18, and a lower wall 19. Walls 15, 17, 18, 19 form a continuous forward facing edge around wall 14 in such a way that body 3 bounds an internal cavity 20 on all sides except the front.

It will not go beyond the scope of this invention if body 3 is manufactured by assembling several parts or, in particular in the situation of body 3 in which cavity 20 is open, if striking wall 2 is wholly or partly constructed as a single block with body 3.

The manufacture of a club head of the type illustrated is greatly simplified in that when body 3 has been constructed as a single block with weight 25 by casting, for example, and impact wall 2 is constructed, for example, also by casting, all that is necessary is that peripheral edge 6 of face 5 of wall 2 should be fitted to annular edge 125 of body 1 and then bounded together by any appropriate means and, if desired, cavity 20 and interstitial space 27 may then be filled with a filling material 280 to produce a rough head 1, with respect to which all that is then required is merely to improve the appearance of the surface around perimeter 9.

Finally, although the invention has been described with reference of particular means, materials and embodiments, it is to be understood that the invention is not limited to the particulars disclosed and extends to all equivalents within the scope of the claims.

What is claimed is:

1. A golf club head comprising:

an assembly of walls surrounding an internal cavity;

a striking wall having an inner face facing said internal cavity, said inner face of said striking wall having a peripheral edge having a width, said peripheral edge being connected to a plurality of said assembly of walls; and at least one of said plurality of walls including a ballasting weight being disposed proximate to said inner face of said striking wall, but being separated from said inner face of said striking wall by an interstitial space communicating with said cavity, said interstitial space having a width smaller than said width of said peripheral edge.

2. A golf club head according to claim 1, said ballasting weight being integral with said at least one of said plurality of walls and being defined by at least a portion of said at least one of said plurality of walls having an increased thickness.

3. A golf club head according to claim 1, said interstitial space having a substantially constant width between said ballasting weight and said inner face of said striking wall.

4. A golf club head according to claim 1, said plurality of walls defining a continuous edge of substantially constant thickness extending around said periphery of said inner face of said striking wall.

5. A golf club head according to claim 4, said interstitial space between said ballasting weight and said inner face of said striking wall having a substantially constant width substantially smaller than said substantially constant thickness of said continuous edge.

6. A golf club head according to claim 5, said width of said interstitial space being approximately one-fourth of said substantially constant thickness of said continuous edge.

7. A golf club head according to claim 1, said cavity being completely enclosed.

8. A golf club head according to claim further comprising a filling material filling said cavity and said interstitial space.

9. A golf club head according to claim 1, said ballasting weight being located in a lower part of said cavity.

10. A golf club head according to claim 9, said cavity having a heel portion, and said ballasting weight being additionally located in said heel portion of said cavity.

11. A golf club head according to claim 10, said cavity additionally having a toe portion, and said ballasting weight being additionally located in said toe portion of said cavity.

12. A golf club head according to claim 9, said cavity having a toe portion, and said ballasting weight being additionally located in said toe portion of said cavity.

13. A golf club head according to claim 1, said ballasting weight being constructed as a unitary block with said at least one of said plurality of walls.

14. A golf club head according to claim 1, said plurality of walls being constructed as a unitary block.

15. A golf club head according to claim 1, said striking wall abutting against said plurality of walls.

16. A golf club head according to claim 15, said striking wall having a continuous peripheral edge extending around said inner face of said striking wall, said plurality of walls together forming a continuous annular edge confronting said inner face of said striking wall and arranged for cooperation with said continuous peripheral edge of said striking wall, said continuous peripheral edge and said continuous annular edge being connected together in an integral manner.

17. A golf club head according to claim 16, said inner face, said continuous peripheral edge, and said continuous annular edge being substantially planar.

18. A golf club head according to claim 16, said continuous peripheral edge and said continuous annular edge being secured together by one of the group consisting of welding, brazing, and adhesive bonding.

19. A golf club head according to claim 1, said interstitial space being continuous.

20. A golf club head according to claim 1, further comprising a rear wall connected to said plurality of walls.

21. A golf club head according to claim 1, further comprising an end piece connected to one of said plurality of walls, said end piece being configured for connection to a shaft.

22. A golf club head according to claim 1, further comprising an end piece connected to said striking wall, said end piece being configured for connection to a shaft.

23. A golf club head according to claim 1, in combination with a shaft connected to said golf club head.

24. A golf club head comprising:

an assembly of walls surrounding an internal cavity;

said assembly of walls comprising a striking wall having an inner face facing said internal cavity, said inner face of said striking wall having a periphery which is connected to a plurality of said assembly of walls; and at least one of said assembly of walls including a ballasting weight extending into said cavity, said ballasting weight having at least an upper portion disposed separated from said inner face of said striking wall by an interstitial space communicating with said cavity, but proximate to said inner face of said striking wall, said assembly of walls including an annular edge, said annular edge having a thickness, said interstitial space being less than said thickness of said annular edge.

25. A golf club head according to claim 24, in combination with a shaft connected to said golf club head.

* * * * *